US006580203B1

(12) United States Patent
Elzinga et al.

(10) Patent No.: US 6,580,203 B1
(45) Date of Patent: Jun. 17, 2003

(54) LOW-PRESSURE GAS DISCHARGE LAMP HAVING ADAPTER INCLUDING CONTACT ELEMENT PROVIDED WITH BARBED HOOK

(75) Inventors: Marcus Johannes Gerardus Elzinga, Roosendaal (NL); Petrus Johannes Maria Fransen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 224 days.

(21) Appl. No.: 09/610,597

(22) Filed: Jul. 5, 2000

(30) Foreign Application Priority Data

Jul. 7, 1999 (EP) ..... 99202213

(51) Int. Cl.[7] ..... H01J 5/48; H01J 5/50

(52) U.S. Cl. ..... 313/318.1; 313/318.01; 313/634

(58) Field of Search ..... 313/318.1, 318.01, 313/318.02, 318.03, 318.04, 318.09, 493, 634

(56) References Cited

U.S. PATENT DOCUMENTS

| | | | | | |
|---|---|---|---|---|---|
| 3,739,118 | A | * | 6/1973 | Bounds | 200/61.45 R |
| 3,780,328 | A | * | 12/1973 | Boddy et al. | 313/579 |
| 4,683,402 | A | * | 7/1987 | Aubrey | 315/56 |
| 4,785,218 | A | * | 11/1988 | Kohl et al. | 313/579 |
| 4,803,600 | A | | 2/1989 | Pepping | 362/217 |
| 4,994,710 | A | * | 2/1991 | Roelevink et al. | 313/318.02 |
| 5,086,249 | A | * | 2/1992 | Blaisdell et al. | 313/318.1 |
| 5,313,134 | A | * | 5/1994 | Borgis et al. | 313/318.01 |
| 5,545,944 | A | * | 8/1996 | Cannon | 313/318.01 |
| 5,703,428 | A | * | 12/1997 | Borgis | 313/318.1 |
| 5,952,773 | A | * | 9/1999 | Manders et al. | 313/318.09 |
| 6,005,337 | A | * | 12/1999 | Papp et al. | 313/318.01 |
| 6,276,812 | B1 | * | 8/2001 | Helbig et al. | 362/226 |

FOREIGN PATENT DOCUMENTS

| | | | |
|---|---|---|---|
| DE | 2731413 A1 | 1/1979 | H01R/33/08 |
| DE | 3329950 A1 | 2/1985 | H01R/33/94 |
| DE | 3744253 A1 | 7/1989 | H01K/1/48 |
| WO | WO9910955 | 3/1999 | H01R/33/08 |

* cited by examiner

*Primary Examiner*—Vip Patel
*Assistant Examiner*—Kevin Quarterman
(74) *Attorney, Agent, or Firm*—Frank Keegan

(57) ABSTRACT

The low-pressure gas discharge lamp has a tubular lamp vessel (1) provided at both of its ends (12) with a lamp cap (4) having contact pins (5). Each lamp cap (4) is fixed in an adapter (6) which, depending on the embodiment chosen, has a certain number of external contact points (7) electrically connected to at least one of the contact pins (5) of the lamp cap (4). Thus the low-pressure gas discharge lamp has the possibility of being connected to various connector buses.

24 Claims, 4 Drawing Sheets

LOW-PRESSURE GAS DISCHARGE LAMP HAVING ADAPTER INCLUDING CONTACT ELEMENT PROVIDED WITH BARBED HOOK

BACKGROUND OF THE INVENTION

The invention relates to a low-pressure gas discharge lamp comprising a tubular lamp vessel with two ends, which lamp vessel is sealed in a gastight manner at both ends over current supply conductors which extend from the exterior of the lamp vessel through respective ends to respective adjacent electrodes arranged in the lamp vessel;

a lamp cap which defines an axis, which is connected to the end of the lamp vessel, and which is provided with a contact pin which is connected to at least one current supply conductor;

an adapter which defines an adapter axis substantially coinciding with the axis of the lamp cap, which adapter has a bottom extending transversely to the adapter axis and an upright circumferential wall surrounding the adapter axis, whereby a cavity is realized in the adapter, inside which cavity the adapter is provided with a contact element comprising a retaining element by means of which the contact element is electrically connected to the contact pin and is mechanically retained on the contact pin of the lamp cap.

Such a low-pressure gas discharge lamp is known from U.S. Pat. No. 4,994,710. The known lamp is a low-pressure mercury vapor discharge lamp which has coating of fluorescent powder on the inner surface of the discharge vessel. The fastening of the adapter to the lamp vessel of the known lamp is realized by means of the contact element and by means of an external contact point. For this purpose, the contact element is fastened to the contact pin of the lamp by means of a retaining element comprising a scraping contact on the one hand, and on the other hand is fastened to the external contact point by means of rolling over, whereby a flange is formed. The external contact point extends from the cavity through the bottom to the exterior of the adapter and has a widened portion at the area where it issues from the adapter. The flange and the widened portion together fix the adapter on the external contact point. The known lamp has the disadvantage that an external contact point is necessary for fixing the adapter on the lamp. A widened portion is to be formed in the contact point for fixing the adapter to the contact point, and this portion is to be rolled over on the contact element, which is a comparatively expensive and laborious process. Another disadvantage of the lamp is that a lamp provided with a "blind adapter", i.e. an adapter without an external contact point, is not easily realizable in this way.

SUMMARY OF THE INVENTION

The invention has for its object to provide a lamp of the kind described in the opening paragraph whose construction is simple and easy to realize, thus rendering possible a simple electrical connection at one end of the lamp.

According to the invention, this object is achieved in that the contact element is further provided with at least one barbed hook for fastening the contact element in the adapter. The barbed hook is an integral part of the contact element and can be formed in a simultaneous operation during the manufacture of the contact element. When the contact element is mounted in the adapter, the contact element is introduced into the cavity of the adapter with a comparatively narrow fit. Removal, however, is not possible because the barbed hook anchored itself in the circumferential wall of the adapter. The contact element is thus fixed in the cavity of the adapter in a comparatively simple and inexpensive manner.

In an embodiment, the low-pressure gas discharge lamp is characterized in that the barbed hook is provided resiliently on the contact element. This has the advantage that the comparatively narrow fit is allowed to be somewhat less narrow and less accurate because the barbed hook is bent during insertion of the contact element and despite the less accurate fit is yet kept pressed against the circumferential wall with clamping force. The risk of rejects owing to an insufficient fit and/or damage owing to the insertion is reduced thereby, while also the risk of the contact element becoming detached from the cavity of the adapter is reduced.

In a further embodiment, the low-pressure mercury discharge lamp is characterized in that the retaining element comprises a scraping contact. A scraping contact is simple to construct, and an inserted contact pin is electrically contacted in a comparatively simple manner and securely fixed owing to its anchoring properties.

In a further embodiment, the low-pressure gas discharge lamp is characterized in that the retaining element is constructed as a resilient tongue. The resilient tongue, which is bent along with the contact pin when this contact pin is being inserted and is kept pressed against the relevant contact pin with clamping force, thus provides a permanent and good electrical contact, while at the same time the risk of the contact pin becoming detached from the retaining element is reduced. A very secure coupling between the contact pin and the retaining element is obtained when the retaining element is constructed as two resilient tongues in axially mutually opposed locations and cooperates with both contact pins of the lamp cap.

In a favorable embodiment, the low-pressure gas discharge lamp is characterized in that the contact element comprises a support wall situated axially opposite the resilient tongue for laterally supporting the contact pin on which the resilient tongue bears. The following equation holds for the compression force exerted by the resilient tongue on the contact pin:

$$F=C*A$$

with:

F=compression force;

C=spring constant of resilient tongue;

A=deflection of resilient tongue.

When the contact pin is inserted into the retaining element, the required space for the contact pin is provided through bending of the resilient tongue. Since the resilient tongue has a deflection A which is twice the deflection of two axially mutually opposed resilient tongues, owing to the axially opposed support wall which is rigid and has substantially no deflection, a double compression force on the contact pin is realized by the resilient tongue. The risk that the contact pin may become detached from the retaining element is further reduced thereby. In addition, the advantage is obtained that the compression force is entirely generated by the contact element itself and not by the adapter, because the resilient tongue and the axially opposed support wall are integrally provided inside the contact element.

In an embodiment, the low-pressure gas discharge lamp is characterized in that the contact element has an external contact point which extends from the cavity through the bottom to the exterior of the adapter. An adapter preferably comprises 1, 2, or 4 external contact elements with external contact points. An electrical connection to other electrical elements, for example luminaires, can be realized in a simple manner by means of the external contact points.

In an embodiment, the low-pressure gas discharge lamp is characterized in that the contact element is provided with a cutting contact. A connection of, for example, an electric wiring can be realized in a simple manner by means of a cutting contact. The wiring may subsequently be guided along the lamp vessel from the one to the other end. One end of the lamp may accordingly be provided with a "blind adapter". This renders it possible to provide the lamp with an electrical connection at one end only, and the lamp will be safe to touch at the same time.

In an embodiment, the low-pressure gas discharge lamp is characterized in that the adapter comprises studs in the cavity which are symmetrically positioned with respect to a mirror plane S, which extends parallel to the adapter axis and passes through the adapter axis, for supporting the contact elements and keeping them in position. Mounting of the adapter is further simplified here in that the contact elements are in a correct orientation and position before mounting.

In an embodiment, the low-pressure gas discharge lamp is characterized in that the adapter is manufactured from synthetic resin. Synthetic resin materials have the advantage over, for example, porcelain or glass that they often have a comparatively low specific mass, can be rendered at relatively low costs, and are resistant to mechanical impact.

In another embodiment, the low-pressure gas discharge lamp is characterized in that the adapter is manufactured from a ceramic material. The ceramic material, for example aluminum oxide, has the advantage over, for example synthetic resin materials, that it has a good resistance towards UV(C)-radiation and relatively high temperatures. The ceramic material has the advantage over glass that it can relatively easily be molded.

In an alternative embodiment, the low-pressure gas discharge lamp is characterized in that the adapter is provided with coupling means. Coupling means may comprise, for example, a handle or a screwthread. The lamp can thus be handled or fastened in a simple manner.

In an embodiment, the low-pressure gas discharge lamp is characterized in that a tensioning and positioning element is provided at the end of the lamp vessel. The tensioning and positioning element is provided on the end of the lamp vessel in that it is passed over the contact pins. When the tensioning and positioning element is used, a connection, for example an electric wiring, is kept under a permanent tensile stress in that the tensioning and positioning element is provided with a clamping slot through which the wiring is passed. The tensioning and positioning element further comprises a positioning passage in which a cutting contact, which forms part of the contact element and is provided in the adapter, can be placed. This renders possible a connection to the wiring simultaneous with the application of the adapter to the end of the lamp vessel, while the connection is comparatively simple.

BRIEF DESCRIPTION OF THE DRAWINGS

Embodiments of the low-pressure gas discharge lamp according to the invention are shown in the drawings, in which.

DETAILED DESCRIPTION OF THE PREFERRED EMBODIMENTS

Figure 1:
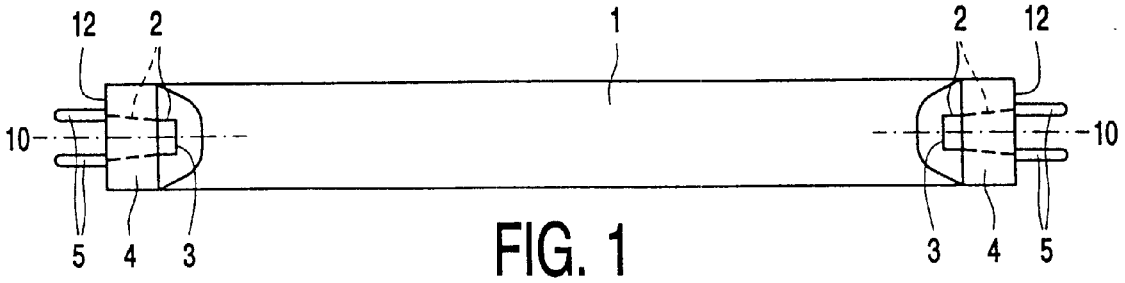
FIG. 1 shows a lamp, partly broken away, in side elevation.
Figure 2:
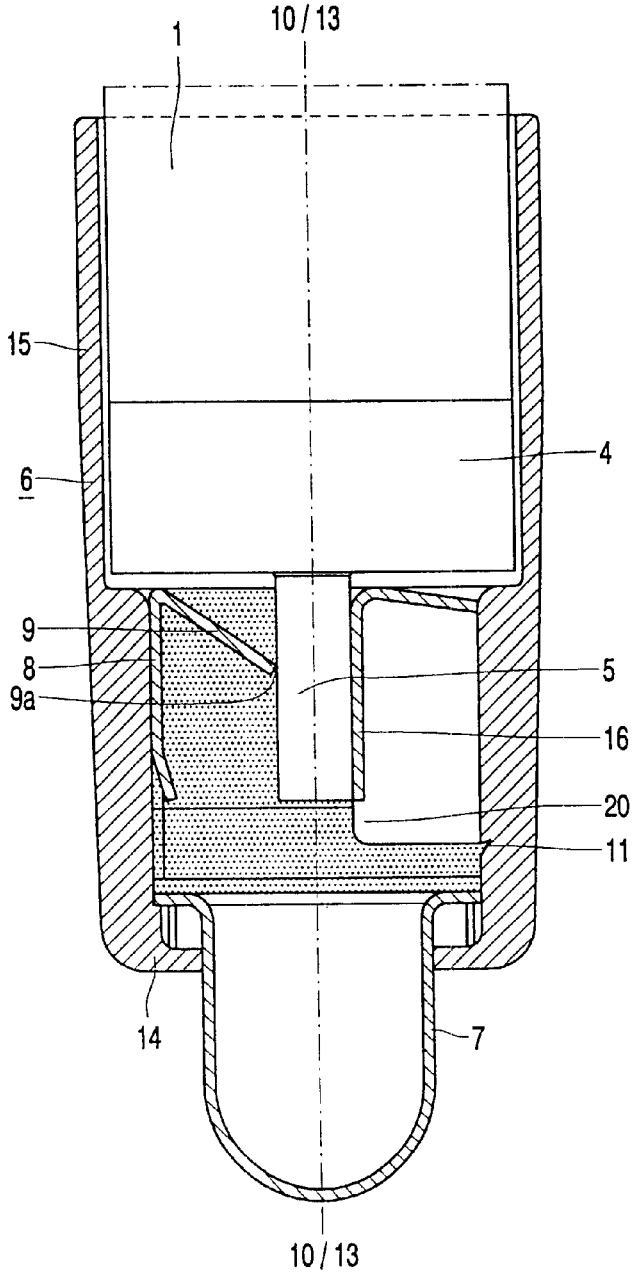
FIG. 2 shows an end portion of the lamp of FIG. 1 in side elevation, provided with a single-pin adapter in longitudinal sectional view.

The low-pressure gas discharge lamp of FIG. 1 (see also FIG. 2) has a tubular lamp vessel 1 which is sealed at each of its two ends 12 in a gastight manner over current supply conductors 2 which extend from the exterior of the lamp vessel 1 through respective ends 12 to respective adjacent electrodes 3 arranged in the lamp vessel 1. The lamp vessel 1 is coated on its inner surface with a fluorescent layer and contains mercury and rare gas. FIG. 1 shows two lamp caps 4, each connected to an end 12 of the lamp vessel 1. The lamp cap 4, which defines an axis 10, has contact pins 5 which are connected to the current supply conductor 2. An adapter 6, which defines an adapter axis 13 which coincides substantially with the axis 10, has a bottom 14 and a circumferential upright wall 15 which is fixed on the lamp cap 4. The adapter 6 is made of synthetic resin, for example of polybutylene teraphthalate. A contact element 8 is present in a cavity 20 of the adapter 6 and is held fixed in the adapter 6 by a resiliently provided barbed hook 11 which anchors itself into the wall 15 of the adapter. The contact element 8 has a central external contact point 7 which is electrically connected to at least one contact pin 5 of the lamp cap 4. The element 8 also has resilient tongues 9 with respective scraping contacts 9*a* as the retaining elements, which bear on the contact pins 5 of the lamp cap 4 with clamping force and counteract a removal of the adapter 6. The contact pins 5 are supported by support walls 16 which are situated axially opposite the tongues. The support walls form an integral part of the contact element 8 and are connected thereto via a portion (not visible in FIG. 2) of the contact element 8 which is bent back.

Figure 3B:
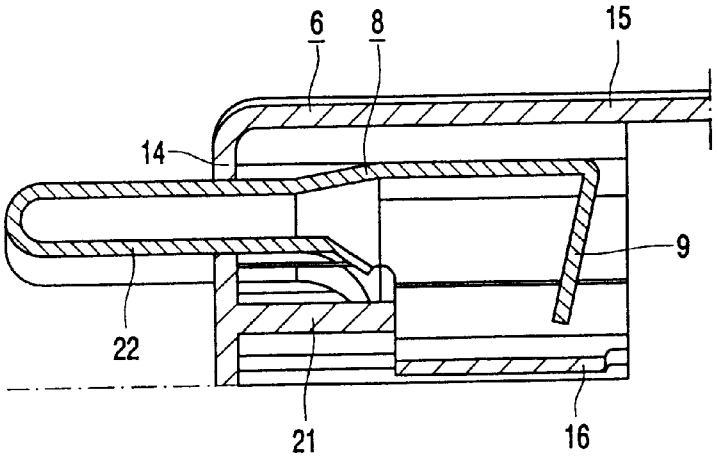
FIG. 3B is a cross-sectional view through the adapter of FIG. 3A taken on the line A—A.
Figure 3C:
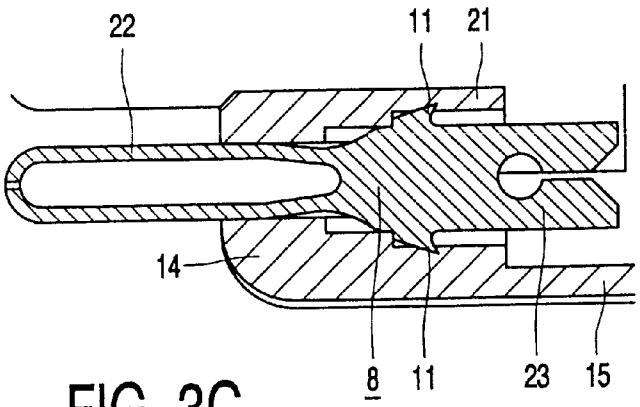
FIG. 3C is a cross-sectional view through the adapter of FIG. 3A taken on the line B—B.
Figure 3A:
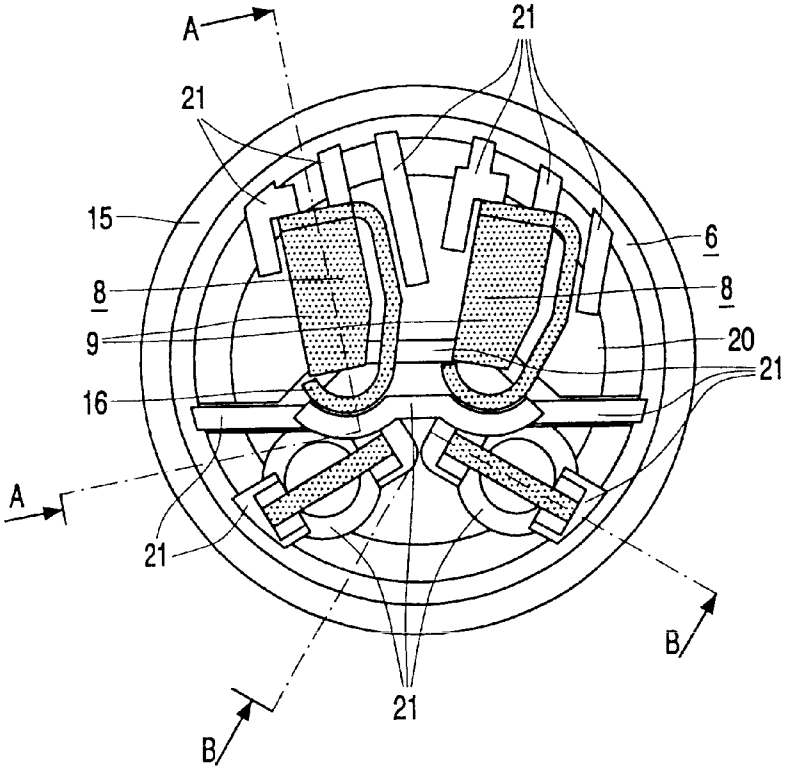
FIG. 3A shows a four-pin adapter, viewed in axial direction from the lamp vessel.

FIG. 3A shows a four-pin adapter 6, viewed in axial direction from the lamp vessel. A number of studs 21 are present in the cavity 20, which is surrounded by the circumferential upright wall 15, which studs support two pairs of mutually somewhat differing contact elements 8 and keep them in position. The contact elements 8 are provided with barbed hooks (not visible). The studs 21 form an integral part of the adapter 6. The first variation in the contact element 8 comprises the resilient tongue 9 and the axially opposed support wall 16. FIG. 3B shows this first contact element 8, where it comprises an external contact point 22 which is passed through the bottom 14 of the adapter 6. FIG. 3C shows the second variation of the contact element 8 in cross-section. This second contact element 8 comprises an external contact point 22 which is passed through the bottom 14 of the adapter 6 and comprises a cutting contact 23 for the connection of an electric wiring, which cutting contact is provided with barbed hooks 11 which are anchored in the wall 15 of the adapter 6. The contact element 8 is fixed in the adapter 6 in this manner.

Figure 4B:
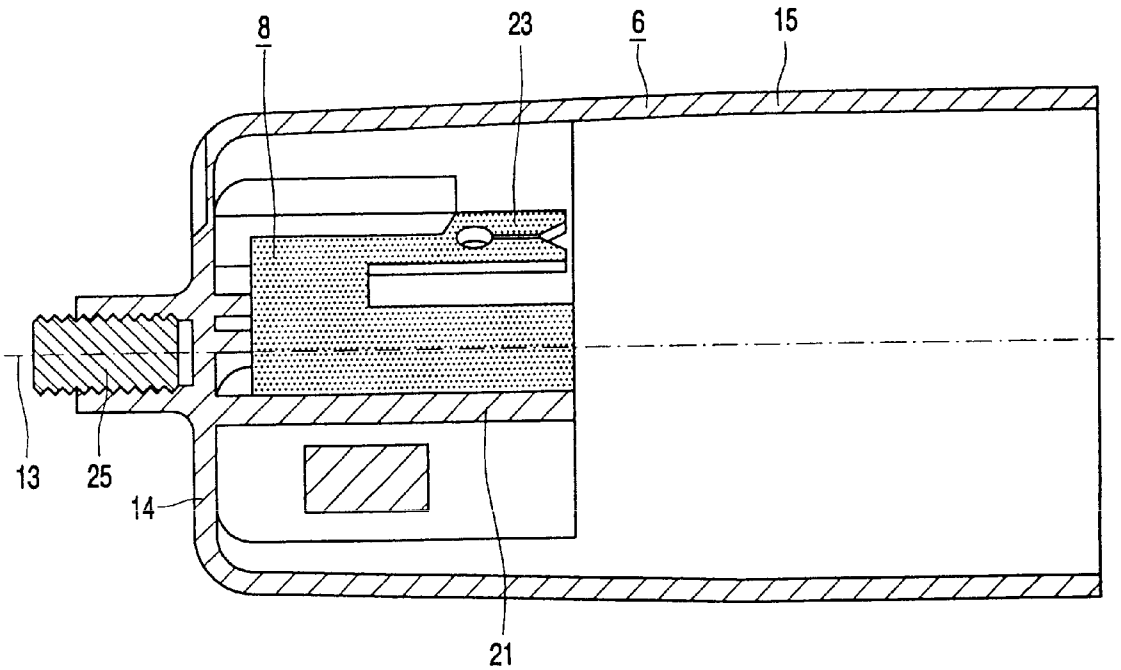
FIG. 4B is a cross-sectional view of the adapter of FIG. 4A taken on the line A—A.
Figure 4A:
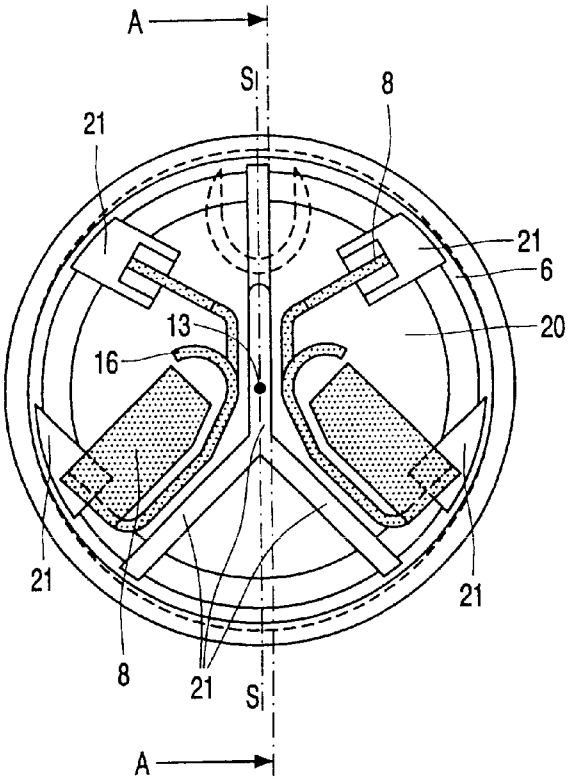
FIG. 4A shows a blind adapter, viewed in axial direction from the lamp vessel.

FIG. 4A shows a blind adapter 6, viewed in axial direction from the lamp vessel, comprising two contact elements 8 which are symmetrically positioned in the cavity 20 with respect to a mirror plane S which extends parallel to the adapter axis 13 and through the adapter axis 13. The contact elements 8 are supported and positioned by means of studs 21 which are provided symmetrically with respect to the mirror plane S in the cavity 20. The studs 21 are integral with the adapter 6. FIG. 4B is a cross-sectional view of the adapter 6 taken on the line A—A with the contact element 8 provided therein. This contact element 8 comprises a cutting contact 23 which realizes a connection to, for example, an electric wiring in a simple manner. The wiring may subsequently be guided along the lamp vessel from the one end to the other end of the lamp. The adapter 6 is accordingly blind, i.e. no external contact point is passed through the bottom 14 of the adapter 6. This renders it possible to provide the lamp with an electrical connection at one end only, which renders the lamp safe to touch at the same time. A coupling element 25, a screwthread with a threaded stud in FIG. 4B, is provided on the bottom 14 of the adapter 6.

Figure 5:
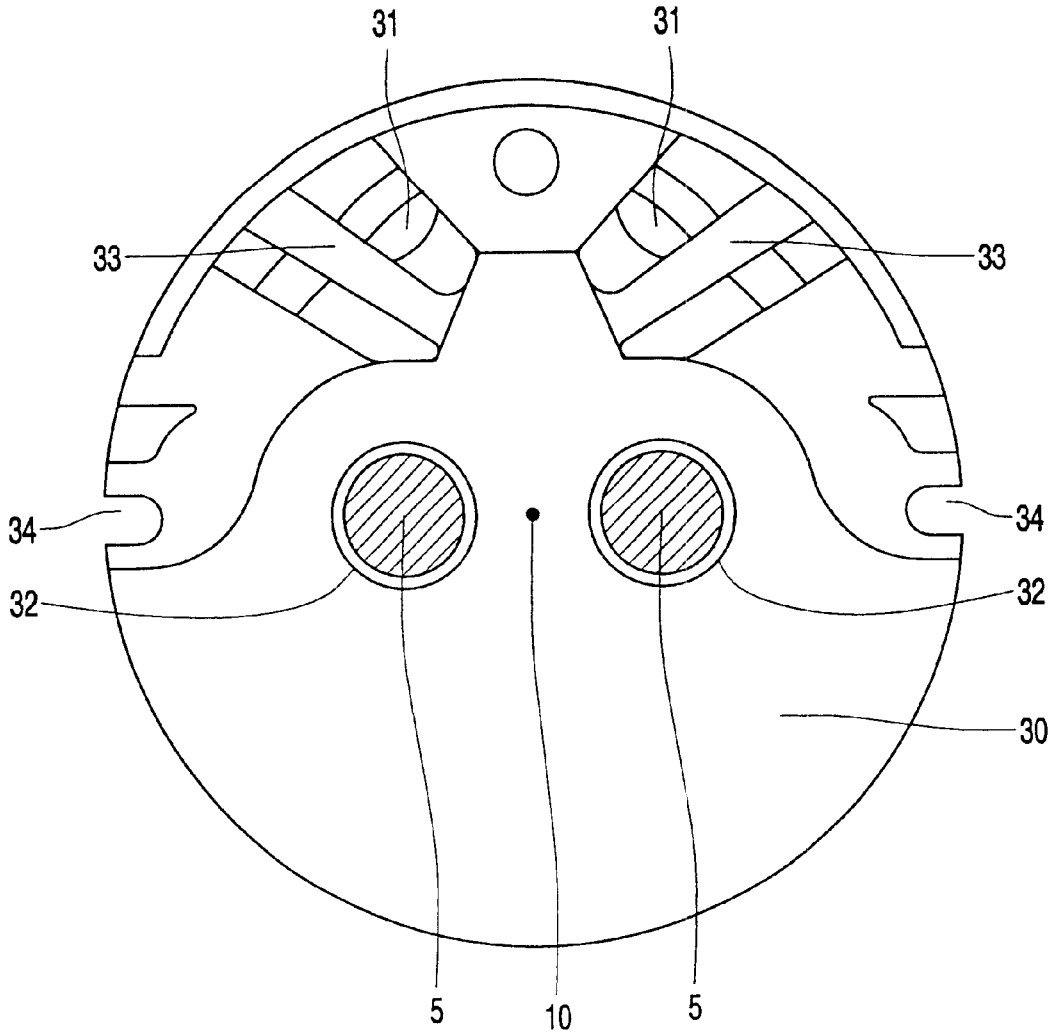
FIG. 5 shows a tensioning and positioning element viewed in axial direction from the contact pins.

FIG. 5 shows a tensioning and positioning element 30 with which the electric wiring guided along the lamp vessel is held tautly tensioned in that the wiring is guided through clamping slots 31. Since the tensioning and positioning element 30 has two openings 32 through which the contact pins 5 of the lamp cap project, the latter lies positioned on the lamp vessel and also perpendicular to the lamp axis 10, and said tensioning and positioning element 30 keeps the wiring in a correct position for realizing an electrical connection by means of the cutting contacts. The cutting contacts are provided in an adapter and operate for realizing the electrical connection of the wiring in cooperation with the tensioning and positioning element 30. To achieve this connection, a cutting contact is placed on the tensioning and positioning element 30 in a positioning passage 33. The tensioning and positioning element 30 is further provided with recesses 34, through which the wiring is guided, so as to achieve a positioned guiding of the wiring along the lamp vessel. Such a tensioning and positioning element 30 is preferably used for a lamp which is provided with an external contact point at one end only. After the tensioning and positioning element 30 has been provided on the end of the lamp vessel in that it was passed over the contact pins 5, and the wiring has been connected to these contact pins 5, the adapter is passed over the end and the tensioning and positioning element so as to render the lamp safer to handle.

What is claimed is:

1. A low-pressure gas discharge lamp comprising a tubular lamp vessel with two ends, which lamp vessel is sealed in a gastight manner at both ends over current supply conductors which extend from the exterior of the lamp vessel through respective ends to respective adjacent electrodes arranged in the lamp vessel;

a lamp cap which defines an axis, which is connected to the end of the lamp vessel, and which is provided with a contact pin which is connected to at least one current supply conductor;

an adapter which defines an adapter axis substantially coinciding with the axis of the lamp cap, which adapter has a bottom extending transversely to the adapter axis and an upright circumferential wall surrounding the adapter axis, whereby a cavity is realized in the adapter, inside which cavity the adapter is provided with a contact element positioned substantially parallel to the adapter axis, said contact element comprising a retaining element by means of which the contact element is electrically connected to the contact pin and is mechanically retained on the contact pin of the lamp cap, wherein the contact element is further provided with at least one barbed hook for fastening the contact element in the adapter.

2. A low-pressure gas discharge lamp as claimed in claim 1, wherein the barbed hook is provided resiliently on the contact element.

3. A low-pressure gas discharge lamp as claimed in claim 1, wherein the retaining element comprises a scraping contact.

4. A low-pressure gas discharge lamp as claimed in claim 3, wherein the retaining element is constructed as a resilient tongue.

5. A low-pressure gas discharge lamp as claimed in claim 4, wherein the contact element comprises a support wall situated axially opposite the resilient tongue for laterally supporting the contact pin on which the resilient tongue bears.

6. A low-pressure gas discharge lamp as claimed in claim 1, wherein the contact element has an external contact point which extends from the cavity through the bottom to the exterior of the adapter.

7. A low-pressure mercury discharge lamp as claimed in claim 6, wherein the adapter comprises one, two, or four contact elements with external contact points.

8. A low-pressure gas discharge lamp as claimed in claim 1, wherein the contact element is provided with a cutting contact.

9. A low-pressure gas discharge lamp as claimed in claim 1, wherein the adapter comprises studs in the cavity which are symmetrically positioned with respect to a mirror plane S, which extends parallel to the adapter axis and passes through the adapter axis, for supporting the contact elements and keeping them in position.

10. A low-pressure gas discharge lamp as claimed in claim 1, wherein the adapter is manufactured from synthetic resin.

11. A low-pressure gas discharge lamp as claimed in claim 1, wherein the adapter is manufactured from a ceramic material.

12. A low-pressure gas discharge lamp as claimed in claim 1, wherein the adapter is provided with coupling means.

13. A low-pressure gas discharge lamp as claimed in claim 1, a tensioning and positioning element being provided on the end of the lamp vessel, the tensioning and positioning element comprising a clamping slot and a positioning passage, the positioning passage holding wiring in position, said wiring being connected to a second contact element held in the clamping slot.

14. A low-pressure gas discharge lamp comprising a tubular lamp vessel with two ends, which lamp vessel is sealed in a gastight manner at both ends over current supply conductors which extend from the exterior of the lamp vessel through respective ends to respective adjacent electrodes arranged in the lamp vessel;

a lamp cap which defines an axis, which is connected to the end of the lamp vessel, and which is provided with a contact pin which is connected to at least one current supply conductor;

an adapter which defines an adapter axis substantially coinciding with the axis of the lamp cap, which adapter has a bottom extending transversely to the adapter axis and an upright circumferential wall surrounding the adapter axis, whereby a cavity is realized in the adapter, inside said cavity the adapter being provided with a contact element positioned substantially parallel to the adapter axis, extending for a length within said cavity and occupying a portion of a cross section transverse to the adapter axis, said contact element comprising a retaining element by means of which the contact element is electrically connected to the contact pin and is mechanically retained on the contact pin of the lamp cap, wherein the contact element is further provided with at least one barbed hook for fastening the contact element in the adapter.

15. A low-pressure gas discharge lamp comprising a tubular lamp vessel with two ends, which lamp vessel is sealed in a gastight manner at both ends over current supply conductors which extend from the exterior of the lamp vessel through respective ends to respective adjacent electrodes arranged in the lamp vessel;

a lamp cap which defines an axis, said lamp cap being connected to the end of the lamp vessel, and provided with two or more contact pins, each said contact pin being connected to at least one current supply conductor;

an adapter, which defines an adapter axis substantially coinciding with the axis of the lamp cap, said adapter having a bottom extending transversely to the adapter axis and an upright circumferential wall surrounding the adapter axis, whereby a cavity is realized in the adapter, the adapter being provided inside said cavity with two or more contact elements with a length substantially parallel to the adapter axis, each said contact element comprising a retaining element by means of which each said contact element is electrically connected to one of the contact pins and is mechanically retained on said one of said contact pins of the lamp cap, wherein each said contact element is further provided with at least one barbed hook for fastening said contact element in the adapter.

16. A low-pressure gas discharge lamp comprising a tubular lamp vessel with two vessel ends, the lamp vessel being sealed in a gastight manner at both vessel ends over current supply conductors which extend from the exterior of the lamp vessel through at least a respective one of the vessel ends to a respective adjacent electrode arranged in the lamp vessel;

a lamp cap, the lamp cap defining an axis and being connected to one of the vessel ends, the lamp cap being provided with a contact pin connected to at least one current supply conductor;

an adapter defining an adapter axis substantially coinciding with the axis of the lamp cap, the adapter having a bottom extending transversely to the adapter axis and an upright circumferential wall joined to the bottom and surrounding the adapter axis, the bottom and the circumferential wall realizing a cavity in the adapter; and a contact element positioned in the cavity, the contact element having a length substantially parallel to the adapter axis, the length having a first end and a second end, the first end comprising a retaining element, the retaining element urging the contact element against the contact pin and against an axial support wall, the axial support wall being substantially parallel to the adapter axis, the retaining element electrically connecting the contact element to the contact pin and mechanically retaining the contact element on the contact pin of the lamp cap, the second end of the contact element being capable of connection to extend electrical contact to the exterior of the adapter, and the contact element being further provided with at least one barbed hook between the first end and the second end, the barbed hook engaging a wall of the adapter.

17. A low-pressure gas discharge lamp as claimed in claim 16, the retaining element being constructed as a resilient tongue, and the axial support wall being situated axially opposite the resilient tongue, the axial support wall laterally supporting the contact pin.

18. A low-pressure gas discharge lamp as claimed in claim 16, the second end of the contact element comprising an external contact point on the bottom of the adapter.

19. A low-pressure gas discharge lamp as claimed in claim 16, the second end of the contact element not passing an external contact point through the bottom of the adapter.

20. A low-pressure gas discharge lamp as claimed in claim 16, wherein the contact element occupies part of a sector of a cross-section of the adapter, the cross-section being in a plane perpendicular to the adapter axis.

21. A low-pressure gas discharge lamp comprising a tubular lamp vessel with two vessel ends, the lamp vessel being sealed in a gastight manner at both vessel ends over current supply conductors which extend through at least a respective one of the vessel ends to a respective adjacent electrode arranged in the lamp vessel;

a lamp cap, the lamp cap defining an axis and being connected to one of the vessel ends, the lamp cap being connected to at least one current supply conductor;

an adapter defining an adapter axis substantially coinciding with the axis of the lamp cap, the adapter having a bottom extending transversely to the adapter axis and an upright circumferential wall joined to the bottom and surrounding the adapter axis, the bottom and the circumferential wall realizing a cavity in the adapter; and a contact element positioned in the cavity, the contact element having a length substantially parallel to the adapter axis, the length having a first end and a second end, the first end comprising a cutting contact electrically connecting the contact element to the at least one current supply conductor and mechanically retaining the at least one current supply conductor, the second end of the contact element being capable of connection to extend electrical contact to the exterior of the adapter, and the contact element being further provided with at least one barbed hook between the first end and the second end, the barbed hook engaging a wall of the adapter.

22. A low-pressure gas discharge lamp as claimed in claim 21, the second end of the contact element comprising an external contact point on the bottom of the adapter.

23. A low-pressure gas discharge lamp as claimed in claim 21, the second end of the contact element not passing an external contact point through the bottom of the adapter.

24. A low-pressure gas discharge lamp as claimed in claim 21, the current conductor being a wire extending substantially parallel to the adapter axis and a tensioning and positioning element being provided on said one of the vessel ends, the tensioning and positioning element comprising a positioning passage and a clamping slot tautly tensioning the wire, the first end being placed in the positioning passage.

* * * * *